US006224531B1

(12) United States Patent
Frehland et al.

(10) Patent No.: US 6,224,531 B1
(45) Date of Patent: May 1, 2001

(54) ROTOR FOR A FREE JET CENTRIFUGE HAVING AN INTERNAL GUIDING ELEMENT

(75) Inventors: Peter Frehland, Ditzingen; Helmut Fischer, Remseck; Martin Weindorf, Kornwestheim; Olaf Weber, Leonberg, all of (DE)

(73) Assignee: Filterwerk Mann & Hummel GmbH, Ludwigsburg (DE)

( * ) Notice: Subject to any disclaimer, the term of this patent is extended or adjusted under 35 U.S.C. 154(b) by 0 days.

(21) Appl. No.: 09/403,100

(22) PCT Filed: Apr. 16, 1998

(86) PCT No.: PCT/EP98/02219

§ 371 Date: Mar. 6, 2000

§ 102(e) Date: Mar. 6, 2000

(87) PCT Pub. No.: WO98/46361

PCT Pub. Date: Oct. 22, 1998

(30) Foreign Application Priority Data

Apr. 16, 1997 (DE) ..... 197 15 661

(51) Int. Cl.[7] ..... B04B 1/04; B04B 9/06

(52) U.S. Cl. ..... 494/49; 494/79

(58) Field of Search ..... 494/24, 36, 43, 494/49, 64, 65, 67, 74, 79, 81, 84, 901; 210/168, 171, 232, 360.1, 380.1, 416.5; 184/6.24

(56) References Cited

U.S. PATENT DOCUMENTS 2,755,992 * 7/1956 Tait et al. .
3,432,091 * 3/1969 Beazley .
3,666,170 * 5/1972 Cacciabue et al. .
3,823,869 * 7/1974 Loison .
4,210,276 * 7/1980 Lapshev et al. .
4,284,504 * 8/1981 Alexander et al. .
4,468,269 * 8/1984 Carey .
4,824,429 * 4/1989 Keunen et al. .
5,387,174 * 2/1995 Rochat .
5,484,383 * 1/1996 Fitch, Jr. et al. ..... 494/74
5,683,342 * 11/1997 McNair ..... 494/49
5,779,618 * 7/1998 Onodera et al. ..... 494/49
5,882,289 * 3/1999 Sakota et al. .

FOREIGN PATENT DOCUMENTS

942799 * 5/1956 (DE) .
1432891 * 9/1969 (DE) .
1923605 * 11/1969 (DE) .
193000 * 9/1986 (EP) .
699826 * 3/1996 (EP) .
86/06984 * 12/1986 (WO) .
91/09251 * 6/1991 (WO) .
96/19644 * 6/1996 (WO) .

OTHER PUBLICATIONS

Soviet Invnetions Illustrated, Derwent Publications Ltd., London GB; Class 46C, AN 76979024–6 XP 002073090 & SU 173539 A (AGAFONOV), Jul. 1965.*

* cited by examiner

*Primary Examiner*—Charles E. Cooley
(74) *Attorney, Agent, or Firm*—Evenson, McKeown, Edwards & Lenahan, P.L.L.C.

(57) ABSTRACT

A rotor (1) designed to be installed in the housing (16) of a free jet centrifuge, the rotor being provided with at least one inlet (3) and at least one outlet (4), which outlet is configured as a nozzle which is oriented at least substantially tangentially to the axis of rotation (13) of the rotor. The rotor is provided with receptacles for bearings for rotatably mounting the rotor, and the rotor having at least one guide element (7) which extends from an inner wall (38) to an outer wall (39) of a rotor interior space (8). At least the rotor shell (11) is made of synthetic resin material. Owing to its form, the synthetic resin centrifuge rotor can be made up of a reduced number of parts. The rotor may be composed of two elements, a base (10) and a shell (11), connected together either by a snap connection or by welding, such as vibration welding. An oil centrifuge fitted with such a rotor is particularly suitable for cleaning lubricating oil used in an internal combustion engine.

13 Claims, 4 Drawing Sheets

ROTOR FOR A FREE JET CENTRIFUGE HAVING AN INTERNAL GUIDING ELEMENT

BACKGROUND OF THE INVENTION

The invention relates to a rotor which is suitable especially for installation in a free-jet centrifuge.

Such rotors are disclosed, for example, in DE OS 2 532 699, wherein a rotor for a centrifugal cleaning device with a high hub, through which the liquid to be cleaned is fed to inlet openings which are connected with the interior of a rotor chamber, the liquid escaping from one end of the interior of the rotor chamber through one or more reaction nozzles which are so arranged that the rotor is set in rotation, the interior of the rotor being divided by an annular dividing wall into two chambers, namely into a relatively large inlet chamber with which the inlet openings are in communication, as well as a relatively small outlet chamber adjoined by the nozzles, and the inlet chamber and the outlet chamber are connected to one another by an overflow channel which surrounds the hollow hub at a small distance away. Such an apparatus has a great weight and is expensive to manufacture.

Also a rotor is disclosed in DE PS 4014440 for a laboratory centrifuge, which has a plurality of injection molded synthetic resin parts and which has a symmetry with a vertical shaft which simultaneously forms the axis of rotation, such that it is divided circumferentially into a plurality of sectors of identical construction, the sectors having a plurality of radial projections and flat parts running circumferentially, which has a plurality of receptacles for test tubes running radially to the axis of rotation and at an angle. Such an apparatus is not suitable for use as a flow-through centrifuge.

Also a rotor is disclosed in EP A2 608 519 which contains a loosely flexible synthetic resin container for receiving red blood corpuscles, which is by a rotor housing receptacle of metal which absorbs the static forces. In this embodiment the main emphasis is on the creation of a removable, biocompatible container for human secretions to be centrifuged, especially, for example, for separating red blood corpuscles and plasma, wherein the separated blood corpuscles are then removed and purified. This apparatus has a very limited application with regard to the media to be centrifuged.

It is a disadvantage of the known apparatus of the kind described above that they are heavy, expensive, and unsuitable for high rates of throughput, and are not usable for cleaning, for example, a stream of motor oil with its correspondingly high temperatures.

SUMMARY OF THE INVENTION

The present invention, therefore, is addressed to the problem of improving an apparatus of the kind described above so that a rotor will be created which will be safe and reliable in operation, especially as regards throughput and separation boundary, while paying attention to the matter of easy disposal after the end of its useful life.

According to the invention, the problem is solved by a rotor with at least one inlet and at least one outlet for the medium being centrifuged, wherein the rotor has at least one bearing point to receive a bearing element and consists substantially of self-supporting synthetic resin.

Normally, the rotor is installed in an enclosure of a free-jet centrifuge. But it is also conceivable to install it directly into the oil pan of an internal combustion engine.

A weight reduction can be achieved by the use of synthetic resin. In addition, the use of, for example, injection molded parts also offers a considerable cost advantage. Synthetic resins today offer great versatility. They can withstand high temperatures up to about 140° C., which is the case with motor oil, especially when the internal combustion engine in which such a centrifuge can be employed is operated under extreme conditions.

The use of synthetic resin material, however, offers an additional important advantage. It makes it possible to provide guiding elements in the interior of the rotor in an economically reasonable manner.

By extending the guiding elements from the inner hollow hub to the outer wall of the rotor on the one hand, and extending the guiding element from the side of the rotor head facing away from the rotor bottom down to the rotor bottom inside of the rotor housing, the medium being centrifuged is subjected to a positive guidance which, depending on the rotor speed, makes it possible to set a defined boundary of separation with respect to the particles that are to be removed. It is basically also possible to provide guiding elements in sheet metal rotors. This version, however, is not as economical to manufacture.

The outlets configured as nozzles in the rotor assure that the fluid will flow out in a tangential direction with respect to the axis of rotation of the centrifuge. The outlets, however, can be aimed downwardly, in which case a component of force acting against gravity develops on the rotor, which relieves the bearings of the rotor.

In an advantageous embodiment of the invention, the distance of the outlet from the axis of rotation is greater than the outside radius of the rotor. In this manner it is assured that the medium can exit really tangentially from the nozzle, which represents an increase in performance in comparison with the state of the art, on the one hand, and on the other hand starting up is positively influenced and the running speed is substantially more stable.

Also provision can be made according to the invention for providing elements on the outside wall of the rotor to stiffen it in the direction of the main tension axes. This counteracts the flow behavior of the synthetic resin. The guiding elements provided inside of the rotor likewise perform a stiffening function.

In case of a possible use as a mainstream centrifuge, it proves advantageous, especially in low speed ranges, to support the rotor positively with an external drive in order to assure the desired particle size limit, which depends directly on the speed of the rotor. A stable and creep-resistant mounting proves in this case to be advantageous.

A practical embodiment of the invention provides a ball bearing at least at one of the pivots of the rotor. In this manner the start-up performance of the turbine can be improved. Furthermore, the ball bearing can accommodate the axial forces of the rotor which fluctuate according to the state of operation of the centrifuges.

In another advantageous embodiment, the rotor housing has a centrifuge shaft as the mounting element. The use of a shaft made, for example, of steel makes possible a very precisely working mounting in connection with a centrifuge spindle and the corresponding bearings, so that it is possible to use the centrifuge as a mainstream centrifuge without a preceding or following oil filter.

It is advantageous to make the rotor entirely of synthetic resin. This can be accomplished by casting its pivots in one piece with the rotor. This has the positive effect of reducing the number of parts in the centrifuge and enabling the rotor to be disposed of by burning when it is replaced.

The rotor shell and rotor base can be joined together advantageously by snap fastening. Simplification of assembly is thereby achieved. Another possibility is to weld the rotor head and rotor bottom together. The vibration welding method is especially suitable for this purpose, but the rotation welding method, for example, is also conceivable.

In another variant of the invention, an impulse channel is provided in the rotor bottom to form a connection between the rotor interior and the nozzle-like outlet. Thus the otherwise common dividing wall in the centrifuge is rendered unnecessary, which results in a gain in capacity as regards the space that is available for sedimentation.

These and additional features of preferred embodiments of the invention will be found not only in the claims but also in the description and the drawings, and the individual features can be realized each by itself or together in the form of subcombinations in the embodiment of the invention and in other fields, and can constitute advantageous as well as independently patentable embodiments, for which protection is hereby claimed.

Working embodiments of the invention are explained below with reference to the drawing.

DETAILED DESCRIPTION OF PREFERRED EMBODIMENTS

Figure 1:
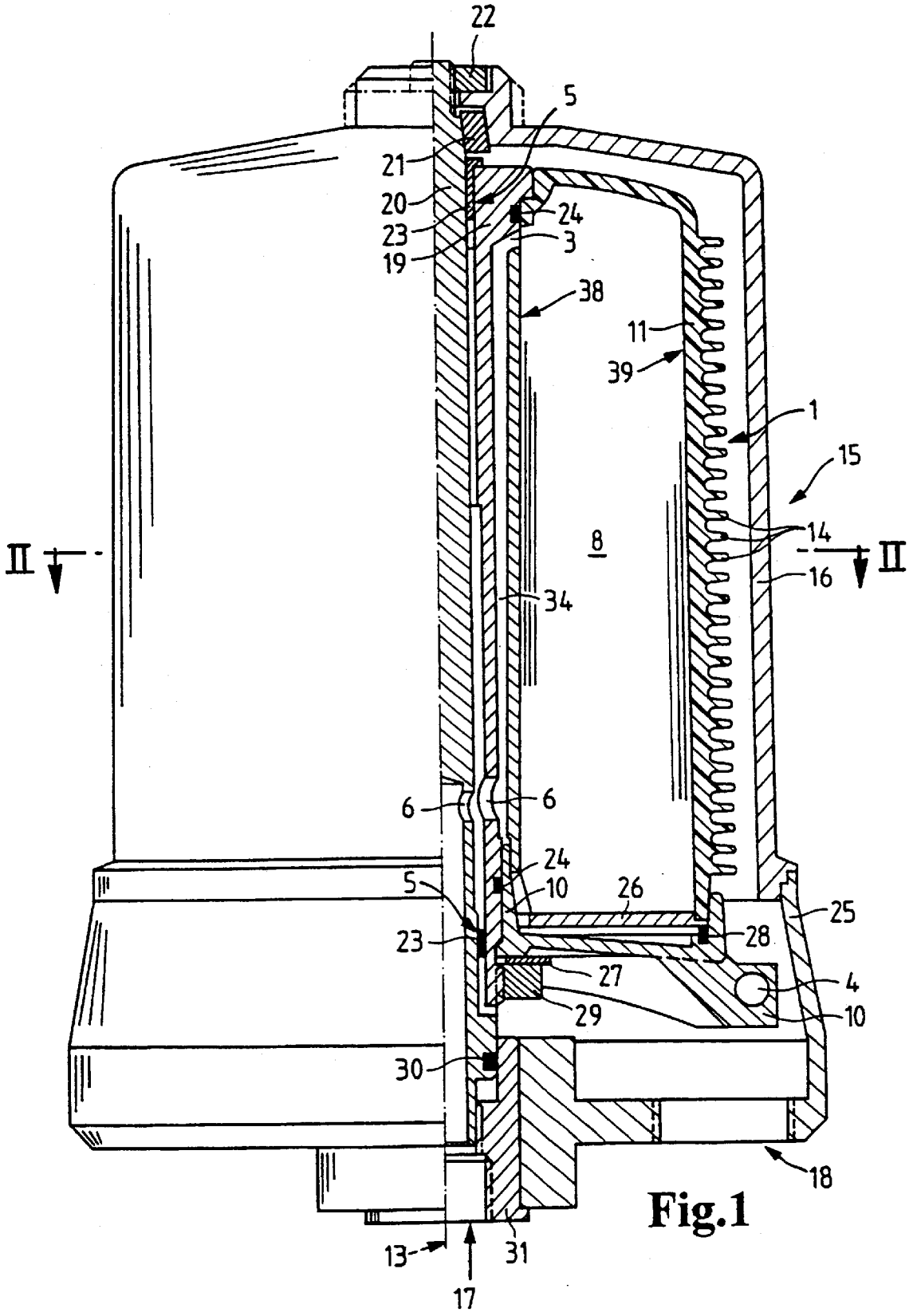
FIG. 1 shows a side elevation of a free-jet centrifuge in which one half along the central axis of the centrifuge is shown cut away.

The rotor 1 illustrated in FIG. 1 has an inlet 3 and an outlet 4. The rotor housing has two pivot points 5. Within the rotor are guiding elements 7 which are not represented in FIG. 1. These guiding elements run radially from the axis of rotation from an inner wall 38 to an outer wall 39 of the rotor. These guiding elements divide the interior 8 of the rotor into a number of areas 9. The actual rotor consists of a rotor bottom 10 and a rotor shell 11. The rotor is made rotationally symmetrical with the axis of rotation 13. To increase the strength of the synthetic resin rotor the latter has stiffening elements 14. Of course, the guiding elements 7 also provide a supporting function for the rotor head 11. The stiffening elements have on the outer circumference of the rotor enclosure the shape of cooling ribs and in case of injection-molded design they may not exceed a certain wall thickness (here: 3–4 mm). The rotor 1 is housed in an enclosure 15 which consists of an upper part 16 and a lower part 25. The centrifuge has an inlet 17 through which the medium to be centrifuged, especially oil from an internal combustion engine, which is not shown here, enters into the rotor interior 8 such that the media being centrifuged flow through the interior of the centrifuge core 19 and centrifuge spindle 20 to the corresponding ports 6. From the ports 6 the medium flows through the passage 34 directly to the inlet 3 of the rotor 1 and through that directly into the rotor interior 8. Inside of the rotor the medium is guided along the guiding elements 7 until it then travels a path past the intermediate floor 26 through the outlet 4 of the rotor to the outlet 18 of the centrifuge, whence it is returned again to the lubricant oil circuit of the internal combustion engine which is not represented.

While the medium is following the above-described path through the centrifuge rotor, impurities in the oil are deposited on the outer wall 39 of the rotor. In the course of time a centrifuge cake builds up there, which is not shown. When a certain limit load on the rotor is reached the rotor has to be either replaced or cleaned.

The rotor 1 is mounted in the centrifuge in cooperation with the centrifuge spindle 20 and the bushed bearings 23 as well as the washer 27, the centrifuge shaft being affixed to the upper part 16 of the enclosure by means of a taper lock with nut 22 in cooperation with a centering bushing 21.

Bushed bearings 23 are arranged between the centrifuge spindle 20 and the hollow centrifuge core 19. The centrifuge core 19 bears the rotor head 11 as well as the rotor bottom 10, and is centered and locked with a washer 27 and a nut 29 on a tapered seat on the hollow shaft.

Between the centrifuge core 19 and the rotor housing are seals 24 to prevent leakage losses. A seal 28 compensates for unavoidable tolerances and settling in the taper lock of the rotor enclosure, and provides for the prevention of undesirable by-passing. The seal 30 prevents any undesired leakage from allowing the medium being centrifuged to flow past the rotor directly to the outlet 18 of the centrifuge. A press-fitted bushing 31 serves as the second support bearing for the centrifuge spindle 20, which becomes effective after the lower part of enclosure 25 is assembled with its corresponding upper part 16 of the enclosure.

Figure 2:
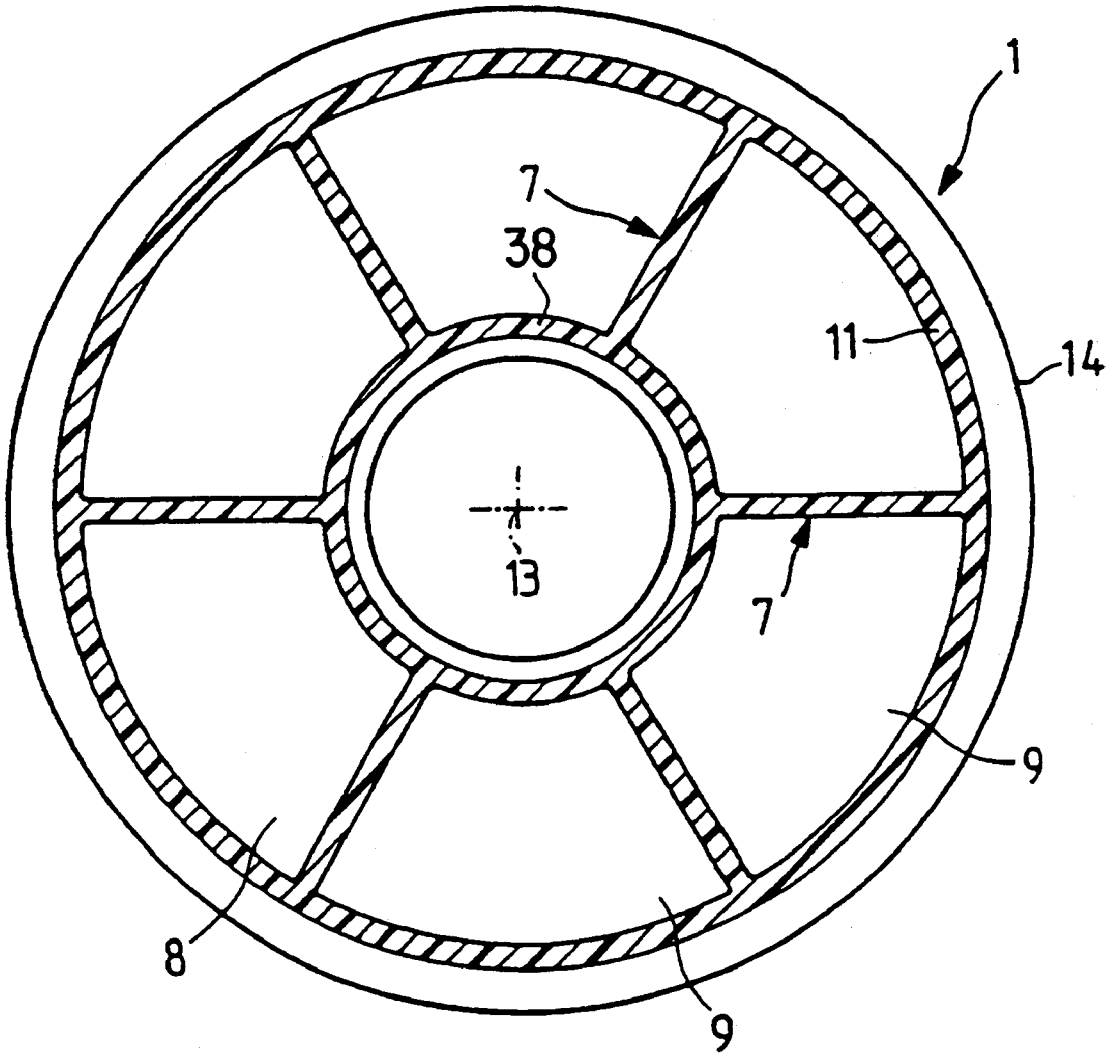
FIG. 2 shows the cross section along line II—II of the rotor shown in FIG. 1.

FIG. 2 shows a section through the rotor 1, in which the rotationally symmetrical structure of the rotor shell 11 with respect to the axis of rotation 13 is clearly seen. The guiding elements 7 extend radially outwardly in a star-like arrangement and at the same time stiffen the rotor housing. Also, the various areas 9 of the rotor interior 8 can be seen, which are separated by the guiding elements 7.

Figure 3:
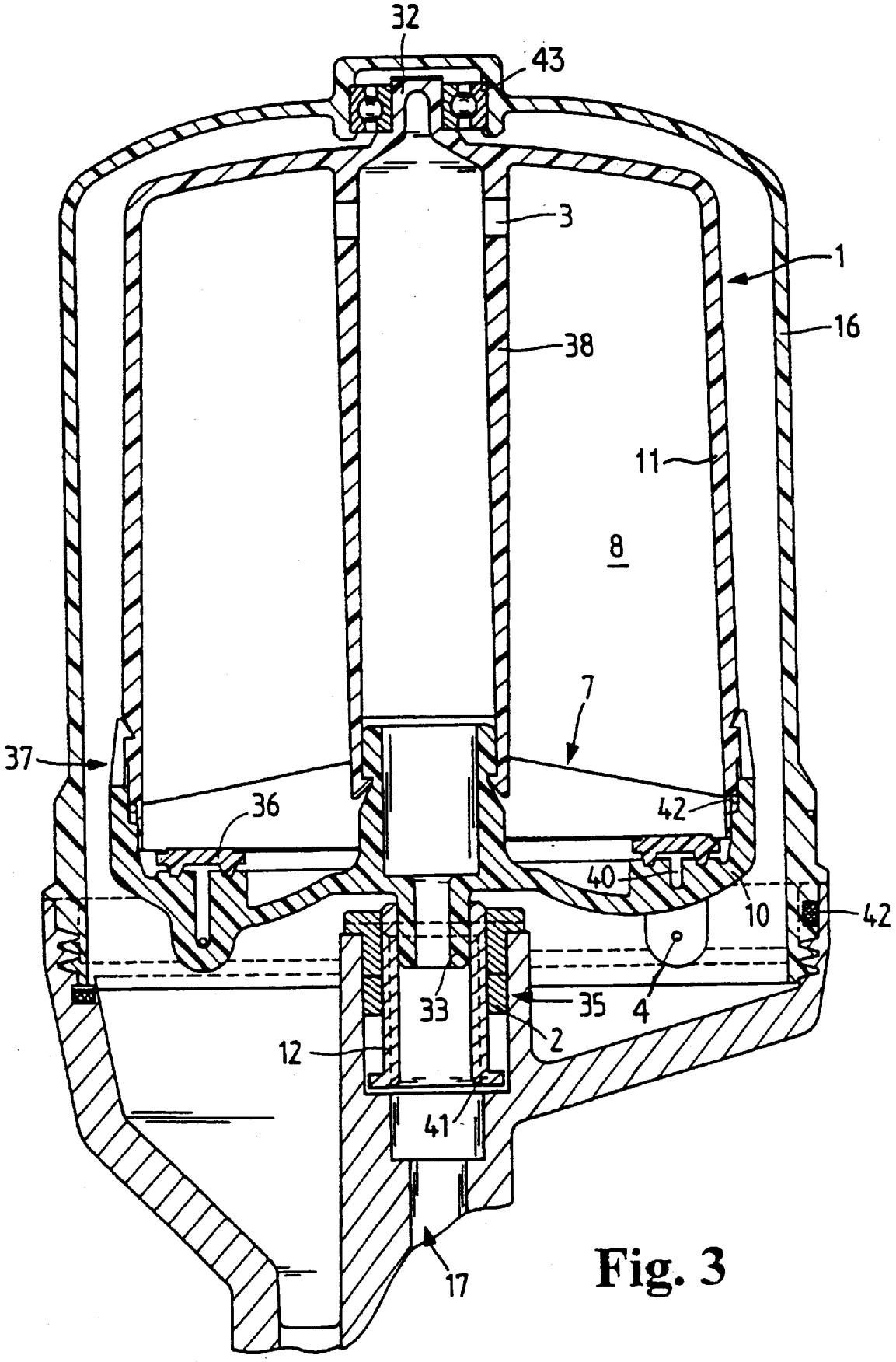
FIG. 3 shows the section through a free-jet centrifuge constructed with an all-synthetic resin rotor, taken along the central axis of the centrifuge.

In FIG. 3 a rotor of all-synthetic resin construction can be seen. The rotor 1 is made up of three parts, consisting of the rotor shell 11 in which the guiding elements 7 and the inner wall 38 are integrated, and the rotor base 10. In the rotor base an impulse channel 40 is provided, which is closed by a channel cover 36 to form a hollow cross section. The channel assures that the medium will be conducted from the rotor interior 8 to the nozzle-like outlets while preventing the conditions of the flow at the outlet from washing out the centrifuge cake. The channel cover can be vibration-welded, for example, to the rotor bottom.

To hold the bearings the rotor has two bearing pins 32 and 33. Bearing pin 32 is closed to prevent bypass by the oil. The rotor can thus be mounted in a ball bearing 43 in the upper part of the enclosure. Bearing pin 33 is open so as to connect the inlet 17 with the inlet 3 in the rotor. The medium can thus flow through the centrifuge in the manner described in connection with FIG. 1.

The bearing engaging the bearing pin 33 consists of a loss protected slide bearing 35. This slide bearing comprises a press-fitted bushing 2 which is made preferably of bronze, and a bearing sleeve 12 which is preferably made of steel. The bearing sleeve has a rim 41 which, when the rotor is changed, prevents escape from the press-fitted bushing 2. The housing upper portion 16 is made preferably of synthetic resin material and is threaded into the housing base made of aluminum, with sealing means 42 being used thereby. The connection between the rotor shell 11 and the rotor base 10 in this embodiment is constructed in the form of a snap fastener 37. Here sealing means 42 can also be used. Alternatively, the snap fastener can have a self-sealing geometry. In the case in which a welded connection is provided to connect the rotor shell and the base, the sealing means likewise may be omitted.

Figure 4:
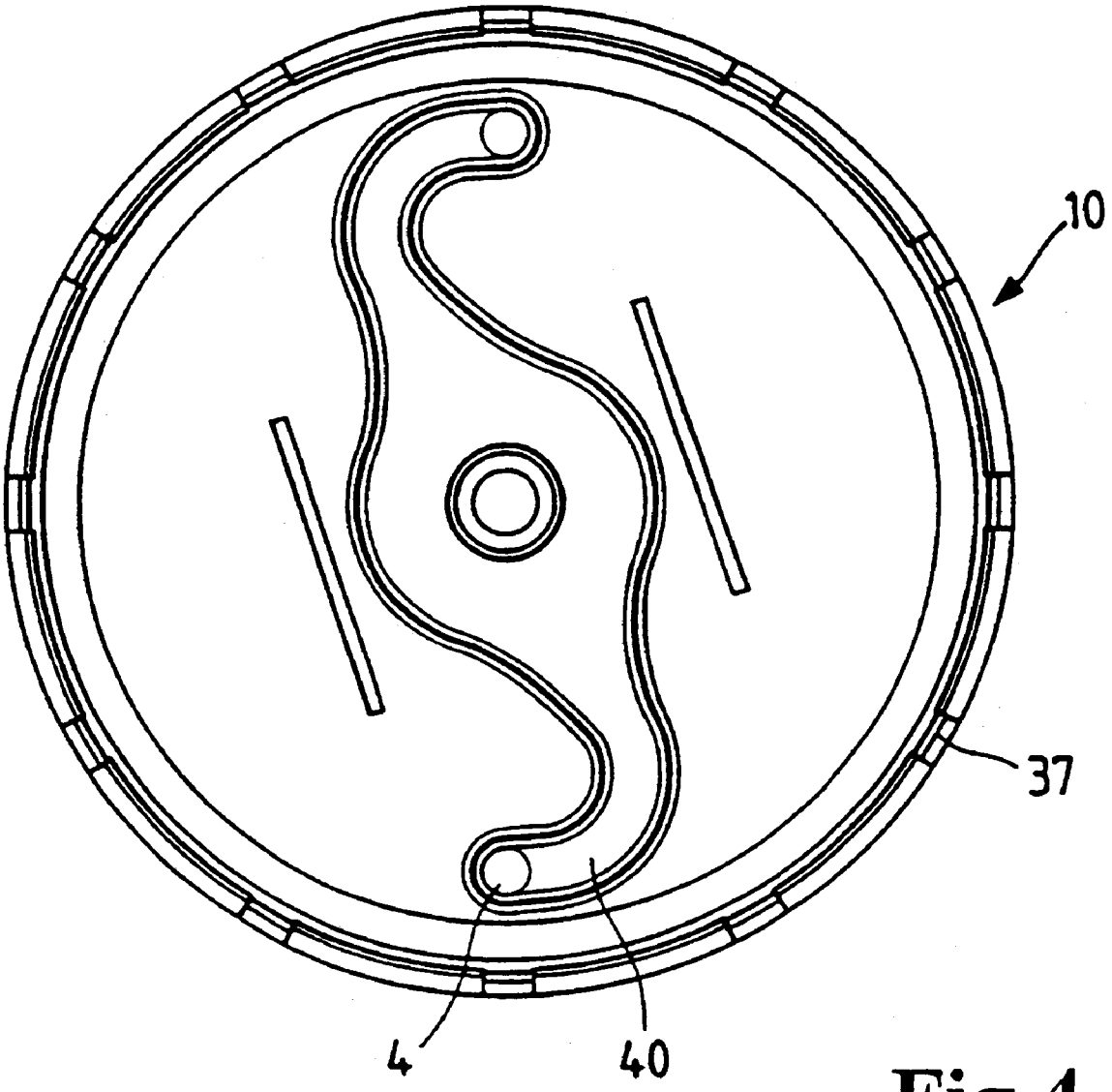
FIG. 4 shows a plan view of the base of a rotor according to FIG. 3.

In FIG. 4 there is shown the rotor bottom 10 in the design using the snap fastener 37. Note the structure which forms the impulse channel 40 in the rotor base. It is shown in its state before the channel cover 36 is installed. At the ends of this structure the outlets 4 which function as nozzles can be seen.

What is claimed is:

1. A rotor for a free-jet centrifuge, said rotor having at least one inlet and at least one outlet, said at least one outlet being configured as a nozzle having an opening oriented at least substantially tangentially with reference to an axis of rotation of said rotor, said rotor further comprising receptacles for receiving mounts for rotatably mounting the rotor, and said rotor comprising at least one guiding element extending from an inner wall to an outer wall of a rotor interior space, said at least one guiding element being fixedly connected to said inner wall and to said outer wall.

2. A rotor according to claim 1, wherein said inner wall, said at least one guiding element, and said outer wall are formed together in one piece.

3. A rotor according to claim 1, wherein said rotor is formed of self-supporting synthetic resin material.

4. A rotor according to claim 1, wherein said rotor further comprises reinforcing elements extending annularly around said rotor shell.

5. A rotor according to claim 1, wherein said mounts for rotatably mounting the rotor comprises at least one ball bearing.

6. A rotor according to claim 1, wherein said rotor comprises a journaled hollow centrifuge shaft and a centrifuge spindle, said centrifuge shaft and said centrifuge spindle constituting said receptacle for receiving said means for rotatably mounting the rotor.

7. A rotor for a free-jet centrifuge, said rotor having at least one inlet and at least one outlet, said at least one outlet being configured as a nozzle having an opening oriented at least substantially tangentially with reference to an axis of rotation of said rotor, said rotor further comprising receptacles for receiving mounts for rotatable mounting the rotor, and said rotor comprising at least one guiding element extending from an inner wall to an outer wall of a rotor interior space, said at least one guiding element being fixedly connected to said inner wall and to said outer wall, wherein said rotor comprises a rotor base and a rotor shell having an outer radius, and said at least one outlet is formed in said rotor base and is spaced from the axis of said rotor a distance greater than the outer radius of said rotor shell.

8. A rotor according to claim 7, wherein said receptacles for receiving mounts for rotatably mounting said rotor comprise bearing receptacles integrated respectively into the rotor shell and the rotor base.

9. A rotor according to claim 7, wherein said rotor shell and said rotor base are joined together by a snap connection.

10. A rotor according to claim 7, wherein said rotor shell and said rotor base are joined together by a welded seam.

11. A rotor according to claim 10, wherein said welded seam is a vibration welded seam.

12. A rotor according to claim 7, wherein an impulse channel is provided in the rotor base communicating between the rotor interior space and said at least one outlet.

13. A rotor for a free-jet centrifuge, said rotor having at least one inlet and at least one outlet, said at least one outlet being configured as a nozzle having an opening oriented at least substantially tangentially with reference to an axis of rotation of said rotor, said rotor further comprising receptacles for receiving mounts for rotatably mounting the rotor, and said rotor comprising at least one guiding element extending from a rotor bottom to a rotor head and extending from an inner wall to an outer wall of a rotor interior space, said at least one guiding element being fixedly connected to said inner wall and to said outer wall.

* * * * *